United States Patent [19]

Torre et al.

[11] 4,315,470

[45] Feb. 16, 1982

[54] WORKPIECE GUIDE CONTROL FOR SEWING UNITS

[75] Inventors: Giancarlo D. Torre, Biassono; Luigi Avesani, Bollate, both of Italy

[73] Assignee: Rockwell-Rimoldi, S.p.A., Milan, Italy

[21] Appl. No.: 185,835

[22] Filed: Sep. 10, 1980

[30] Foreign Application Priority Data

Sep. 25, 1979 [IT] Italy ..... 25964 A/79

[51] Int. Cl.[3] ..... D05B 21/00

[52] U.S. Cl. ..... 112/121.15; 112/121.26; 112/305

[58] Field of Search ..... 112/121.26, 121.15, 112/121.11, 121.29, 305

[56] References Cited

U.S. PATENT DOCUMENTS

| | | | |
|---|---|---|---|
| 4,013,025 | 3/1977 | Marforio | 112/121.26 X |
| 4,116,142 | 9/1978 | Sanvito | 112/121.26 |
| 4,135,464 | 1/1979 | Sanvito | 112/121.26 X |
| 4,227,471 | 10/1980 | Collbrunn et al. | 112/121.26 |

*Primary Examiner*—H. Hampton Hunter

[57] ABSTRACT

A workpiece guide control for a sewing unit in which the guide is mounted for limited sliding movement on the worksurface of the unit intermediate its sewing machine and traveling gripper. The guide slides to a position of close proximity with the stitching instrumentalities and by means of a displacing apparatus operatively associated with the traveling gripper and the guide, the latter as the gripper approaches, is effective in activating the displacing apparatus to effect movement of the guide from the pathway of the gripper and permit the latter to advance to the position from which the guide was displaced.

5 Claims, 6 Drawing Figures

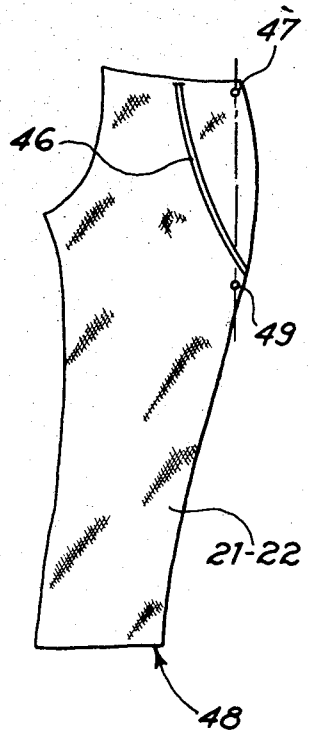
Fig. 6
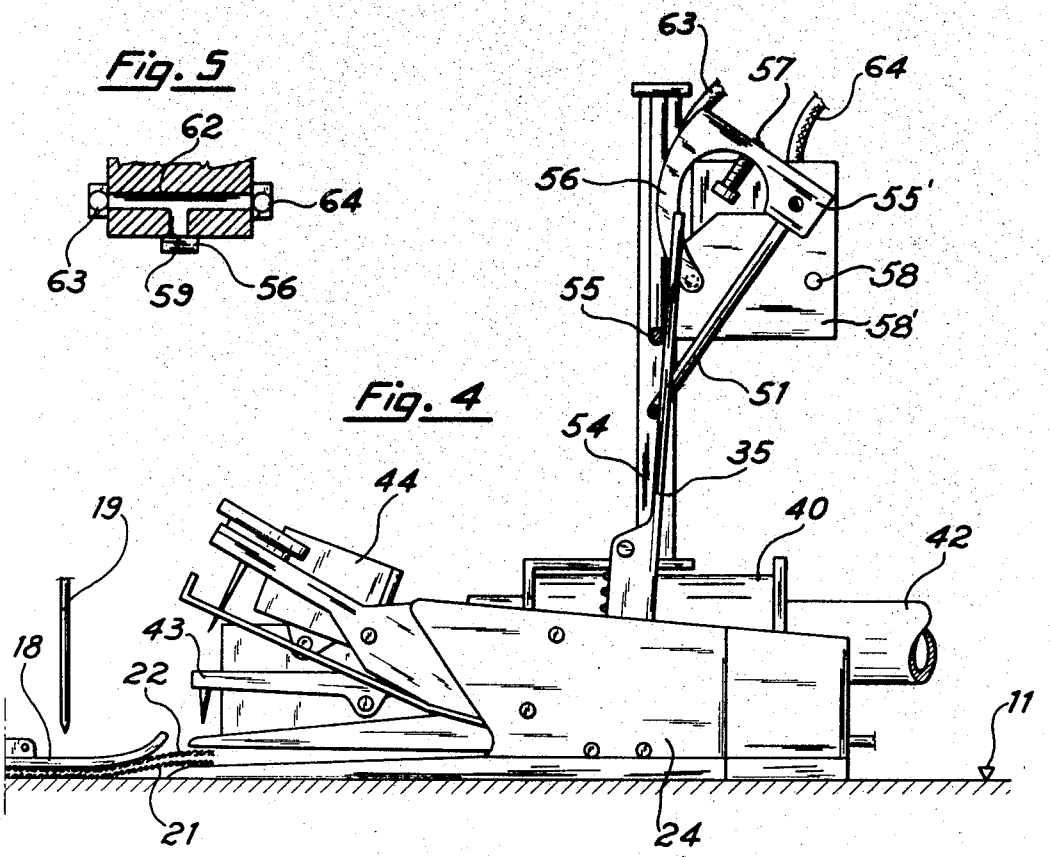
Fig. 4
Fig. 5

WORKPIECE GUIDE CONTROL FOR SEWING UNITS

BACKGROUND OF THE INVENTION

The present invention pertains to a known type of sewing unit having a sewing machine with the usual stitching instrumentalities and means for transporting and advancing a workpiece along the worksurface of a support structure on which said machine is mounted. The unit includes a tensioning device in the form of a traveling gripper which grips the trailing end of a workpiece as it moves along the worksurface. Additionally, the unit includes a workpiece guide formed by a plurality of spaced plate elements disposed one above the other which is located in the path of travel of the workpiece intermediate the stitching instrumentalities and the tensioning device.

Sewing units of the type described are used primarily for the assembly of superimposed layers of fabric such for example as layers for forming trousers wherein the seams are not rectilinear, but follow a pattern determined by the cut of the fabric. This pattern is followed by guiding the separate pieces of fabric within the spaces formed between the plate elements of the workpiece guide. The trailing end of the workpiece is restrained by the traveling gripper having a movable jaw which can be opened by a lever operatively connected thereto. The traveling gripper is continually urged, by any suitable means such as a counterweight, in a direction opposite to the direction of advance of the workpiece.

Frequently workpieces have areas of increased thickness due to the addition of pockets or the like and for such workpieces it is well known to utilize a guiding device which is movable longitudinally along a portion of the path of travel of a workpiece. Such guiding devices are provided with means for gripping the workpiece and moving with the latter to a position of close proximity with the stitching instrumentalities. During actual seaming under these conditions the guiding device is attached to the workpiece at a location spaced from the stitching instrumentalities so that the area of increased thickness is located intermediate said guiding device and said stitching instrumentalities. As sewing continues, the guiding device is caused to be drawn by the workpiece to a position immediately adjacent to the stitching instrumentalities where it is caused to release its hold on said workpiece. In this position the guiding device continues to perform its guiding function on the workpiece until the tensioning device arrives at a position of close proximity with the upstream ends of the plate elements that form the passages in said guiding device.

Additionally, when the areas of increased thickness of a workpiece are located at a considerable distance from the starting point of the seam, it is well known to utilize two guiding devices with a first one being located adjacent the stitching instrumentalities and a second one movable with the workpiece as described above. With this arrangement the first guiding device adjacent the stitching instrumentalities is caused, by any suitable control apparatus, to be displaced from the path of travel of the second guiding device when the latter approaches the sewing zone so that said second device will assume the position of said first device. After the second guiding device takes over the position of the displaced first guiding device, it serves to continually guide the workpiece as described above until the tensioning device arrives at a position of close proximity with the upstream ends of the plate elements of said second guiding device.

The known types of sewing units briefly described above all have the disadvantage of not being able to maintain tension on the trailing portion of the workpiece having a length which corresponds to the distance between the upstream ends of the plate elements where said workpiece is released from the tensioning device and the stitching instrumentalities. This creates an undesirable condition when forming the rest of the seam in the remaining portion of the workpiece for it is likely to be unsatisfactorily incorporated. This is attributed to the fact that the intended function of the guide is lost in the absence of tension on the workpiece and unsatisfactory incorporation of the remaining portion of a seam is more pronounced with guides having plate elements of extra long length.

SUMMARY OF THE INVENTION

To overcome the above disadvantages with these types of sewing units, the present invention provides a workpiece guiding device which in addition to traveling with the workpiece, has a control apparatus that is actuated by the traveling gripper of the tensioning device so as to effect displacement of said guiding device from the path of travel of said tensioning device.

Displacement of the guiding device in this manner then permits the tensioning device to advance to a position of close proximity with the stitching instrumentalities where it is caused to release its grip on the workpiece in a conventional manner. By displacing the guiding device to permit further travel of the tensioning device, the workpiece is held under the desired amount of tension up to the point where the trailing end thereof enters the sewing zone.

The invention can be utilized in a sewing unit having a normally stationary guiding device, as well as a sewing unit for workpieces having portions of increased thickness wherein the guiding device is movable longitudinally along the worksurface and with both types the means for displacing the guides will be initiated by the approach of the tensioning device when it reaches a position of close proximity with the upstream ends of the plate elements forming a part of each guide.

These and other features of the present invention will be made apparent from the following detailed description thereof which is provided with reference to the accompanying drawings, in which:

BRIEF DESCRIPTION OF THE DRAWINGS

FIG. 4 is a view similar to FIG. 3 showing the tensioning device advanced to the position had by the displaced guiding device;

FIG. 5 is a sectional view of a fluid cell forming a part of the control means for effecting displacement of the guiding device; and FIG. 6 is a plan view of one form of workpiece with which the apparatus according to the invention cooperates.

DESCRIPTION OF THE PREFERRED EMBODIMENT

Figure 1:
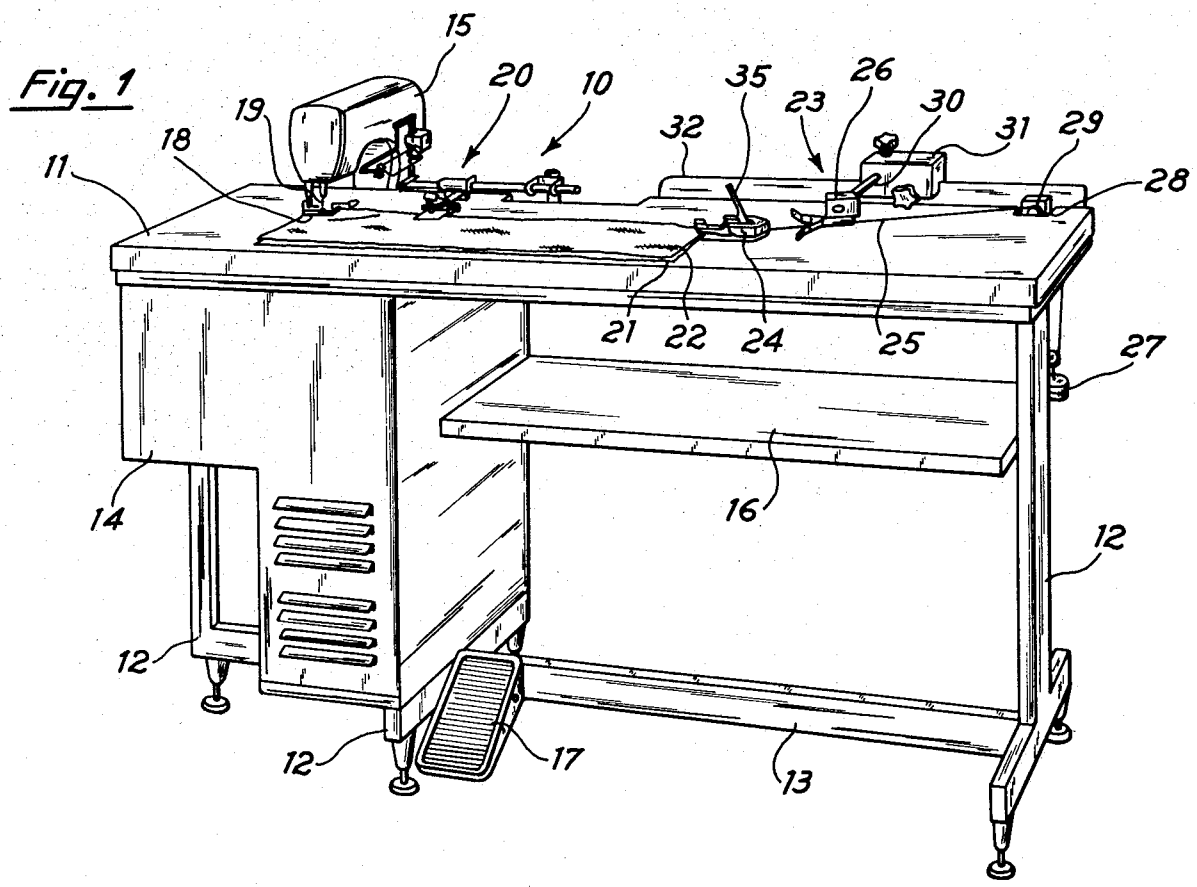
FIG. 1 is a perspective view of the sewing unit to which the guide control according to the invention is applicable.

Referring now to FIG. 1, a sewing unit for the joining of superposed layers of fabric for forming trousers or the like includes a table generally indicated by numeral 10 having a worksurface 11 attached to the upper ends of vertical extending supports 12 which are interconnected by a lower cross-member 13. Below the worksurface 11 one end of the table 10 is enclosed as at 14 and serves to house the usual electrical elements for controlling the operating cycle of a sewing machine 15 that is mounted on and adjacent one end of the worksurface 11. Additionally, an auxiliary surface in the form of a shelf 16 is located below the worksurface 11 and provides a readily assesible surface for additional workpieces to be joined by seaming. A foot pedal 17 is mounted on the cross-member 13 which serves to selectively control actuation of the machine, which includes the lowering of the presser foot 18, actuation of the feed dogs (not shown) as well as its needle that is identified by numeral 19. The workpiece shown in FIGS. 4 and 6 is formed by two pieces of fabric 21 and 22 which are aligned in a guide indicated generally in FIG. 2 by numeral 20 and are maintained under tension by a tensioning device that is depicted generally in FIG. 1 by numeral 23.

This tensioning device includes a gripper 24 which is adapted to grip the trailing end of the workpiece and move along the worksurface 11 so as to follow the displacement of the workpiece during the sewing operation. The gripper 24 is attached at its trailing end to a cable 25 which extends through a guiding and positioning member 26 that is continuously subjected to a pulling force for returning it to its inoperative position. This pulling force defines a counterweight 27 suspended from a pulley 29 with which the cable is operatively associated and said pulley is mounted in an opening 28 in the worksurface 11 adjacent the end opposite the end on which the sewing machine is mounted. The starting position of the tensioning device 23 is selectively positionable on the worksurface 11 in a known manner by means of a shaft 30 extending horizontally from a support block 31 that is mounted for sliding movement on an upwardly directed plate 32 that is fixed to the rear side of the worksurface 11. The tensioning device also includes a finger 35 operatively associated with the gripper 24 which serves as a means for effecting attaching to and detaching said gripper from the trailing end of a workpiece.

Figure 2:
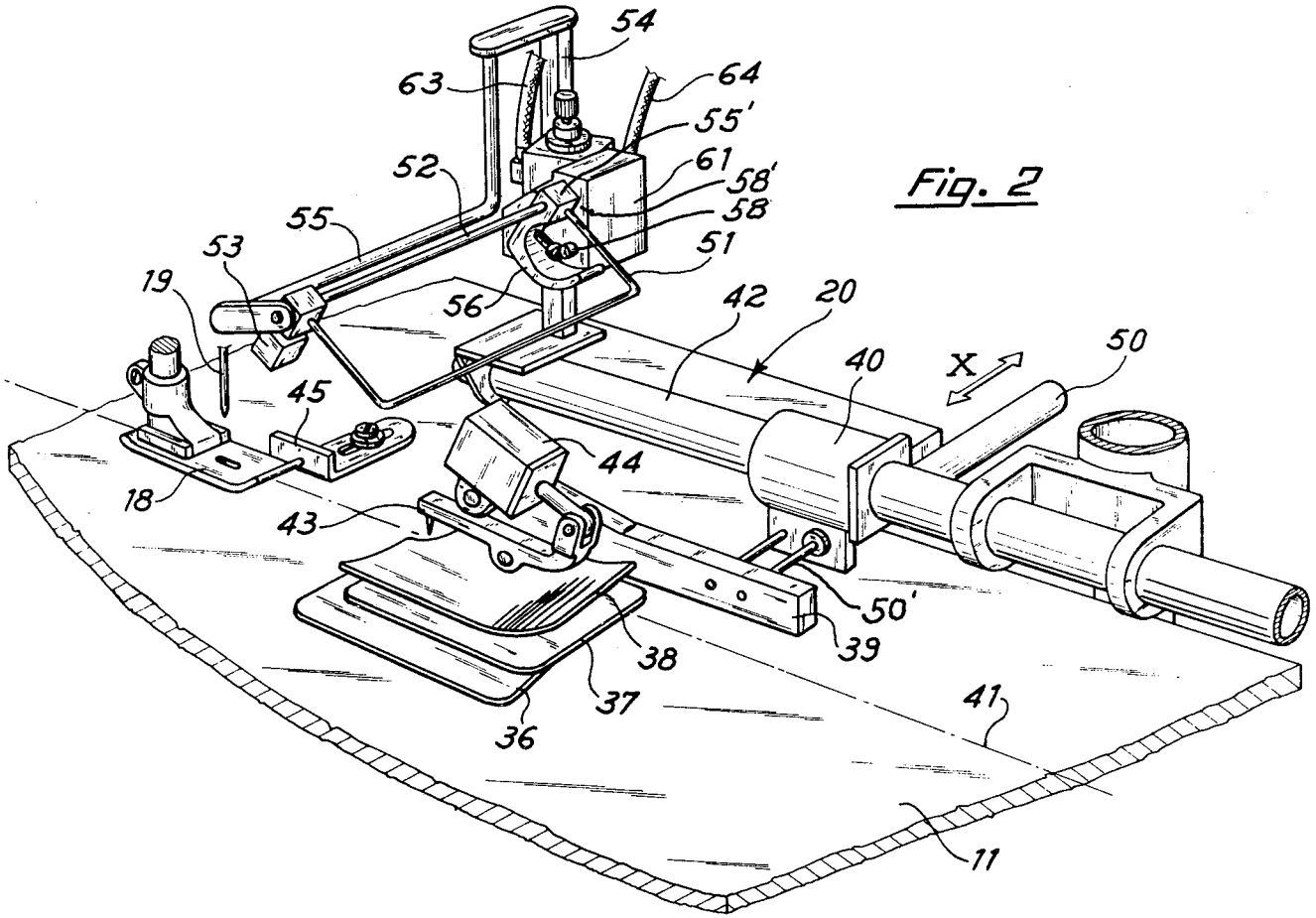
FIG. 2 is a perspective view on an enlarged scale of a portion of FIG. 1 showing the invention in greater detail.

As shown in FIG. 2 the guiding device includes three spaced plate elements 36, 37 and 38 disposed one above the other in generally vertical alignment and the spaces formed therebetween define separate passageways into which the two pieces of fabric 21, 22 are fed. These plate elements 36–38 are attached at one side to a guide support member 39 which is mounted for sliding movement with a sleeve 40 that is carried on a shaft 42. This shaft 42 extends parallel with the line of advancement of a workpiece which is identified in FIG. 2 by numeral 41. At a location corresponding to the downstream ends of the plate elements 36–38, a known device for restraining the workpiece is provided and defines a clip element 43 operatively connected to a piston 44 that is actuated by a fixed stop 45 on the worksurface 11 to effect release of a workpiece from said clip element. Means are provided to effect longitudinal movement of the guiding device along the worksurface 11 so as to accommodate workpieces having areas of increased thickness, due to the addition of pockets or the like, as well as workpieces having contoured outlines as with the fabric pieces for forming trousers shown in FIG. 6.

With workpieces of the type shown in FIG. 6, the seam must be formed along the edge from point 47 to the opposite end 48, and the seam is started by locating the point 47 at a position corresponding to the stitching instrumentalities. Additionally, the intemediate point, depicted by numeral 49 that is downstream of a pocket 46, must be located so as to correspond to the position of the clip element 43 of the guiding device, which at the start of the seaming operation is longitudinally spaced from the stitching instrumentalities.

Upon starting the seaming operation, the advancing means or feed dogs causes the workpiece together with its guide 20 to be drawn in the direction of the stitching instrumentalities, and when said guide 20 arrives at a position of close proximity with said stitching instrumentalities, it is caused to release its grip on the workpiece. After the guide 20 releases the workpiece it remains stationary until it has performed its intended function of guiding the contoured edge of the workpiece extending from point 49 to a point adjacent point 48 which is being gripped by the tensioning device that is also being drawn toward the stitching instrumentalities. When the tensioning device arrives at a position of close proximity with the downstream ends of the guide 20, the latter is caused to be laterally displaced by an actuating mechanism now to be described.

Referring again to FIG. 2 a fluid operated cylinder 50, which in the preferred embodiment is of the pneumatic type, is fixed to the sleeve 40 and its piston rod 51' is operatively connected to the support 39 to shift and maintain it and the elements associated therewith in either of its two available positions. When cylinder 50 is actuated, the piston rod 50' will move the support 39 in one or the other directions depicted by the indicating arrow X which is perpendicular to the line 41 of advancement of a workpiece.

To actuate the cylinder 50 a trigerring element is provided which is located above and in alignment with the path of travel of a workpiece and defines a U-shaped rod 51 the spaced legs of which are operatively connected to a rod 52 that serves as a means for pivotably supporting said rod 51. The rod 51 is located a sufficient distance above the worksurface 11 so that it will not interfere with the advance of the guide 20 to a position of close proximity with the stitching instrumentalities. The rod 51 is mounted so as to pivot freely when engaged by means yet to be described, and is continually urged towards its rest position shown in FIGS. 2 and 3 by a suitable counter-weight 53.

The rod 52 which serves as a fulcrum for rod 51 is supported by a bracket member 54 that is fixedly positioned with respect to the worksurface 11 and which carries a fixed bar 55, the purpose of which will be better understood as the detailed description proceeds.

A control block 55' is operatively connected to the rod 51 for pivotable movement therewith and includes an integrally formed lower portion that defines an arcuated finger 56. This control block 55' is provided with a positioning screw 57 which determines the rest position of the rod 51 by its engagement with a stop pin 58 assembled in the sidewall 58' of a housing 61. One side of the finger 56 is disposed in contiguous relation with the side wall 58' which includes a port 59 that is located in the pathway said finger is caused to follow when pivoted with the rod 51. When the control block 55' and its finger 56 are caused to be pivoted from the position shown in FIG. 3 to that position shown in FIG. 4, the port 59 is closed by said finger 56 and effects a change in the manner in which compressed air is supplied to the cylinder 50. The housing 61 is supported by the bracket member 54 and serves to house a so-called fluidic cell in which a section thereof is shown in FIG. 5 and is essentially formed by a T-connector 62 having an intake port 63 connected to any suitable source of compressed air (not shown), an outlet or feed port 64 that is connected to the cylinder 50 and the port 59 which is open to the atmosphere when the rod 51 is in its rest position. Movement of the finger to a position for closing the port 59 causes the compressed air to be fed to the cylinder 50 which is then activated causing the guide 20 and the various elements mounted thereon to be displaced to a position which will clear the path traveled by the tensioning device as the trailing end of the workpiece arrives at a position of close proximity with the stitching instrumentalities.

To effect a return of the guide 20 to its operating position the port 59 is opened causing the air pressure within the cylinder to be discharged and by any suitable biasing force (not shown) such as a coil spring or the like, said guide 20 will automatically return to its operating position.

The finger 35 associated with the gripper 24 extends from the latter in a generally upwardly direction and is disposed so as to engage the rod 51 as it moves with the workpiece and effect pivoting said rod from the position shown in FIG. 4. The location of rod 51 in the path of travel of the finger 35 is such that the latter will engage said rod when the gripper 24 is but a short distance from the upstream ends of the plate elements 36–38 as shown in FIG. 3.

As the rod 51 is pivoted in the direction of the indicating arrow Y (FIG. 3) toward the position shown in FIG. 4, the control block 55' is also pivoted and the latter's arcuated finger 56 is effective in closing the port 59 resulting in the actuation of the cylinder 50 which as heretofore described is effective in displacing the guide 20 and the elements carried thereby to a position clear of the path of travel of the tensioning device. Movement of the guide 20 in this manner permits the tensioning device with its gripper 24 to be drawn to a position of close proximity with the stitching instrumentalities. Immediately before contact is made between the downstream end of the gripper 24 and the presser foot 18, finger 35 is caused to engage the fixed bar 55 causing said gripper 24 to open and release the trailing end of the workpiece.

Figure 3:
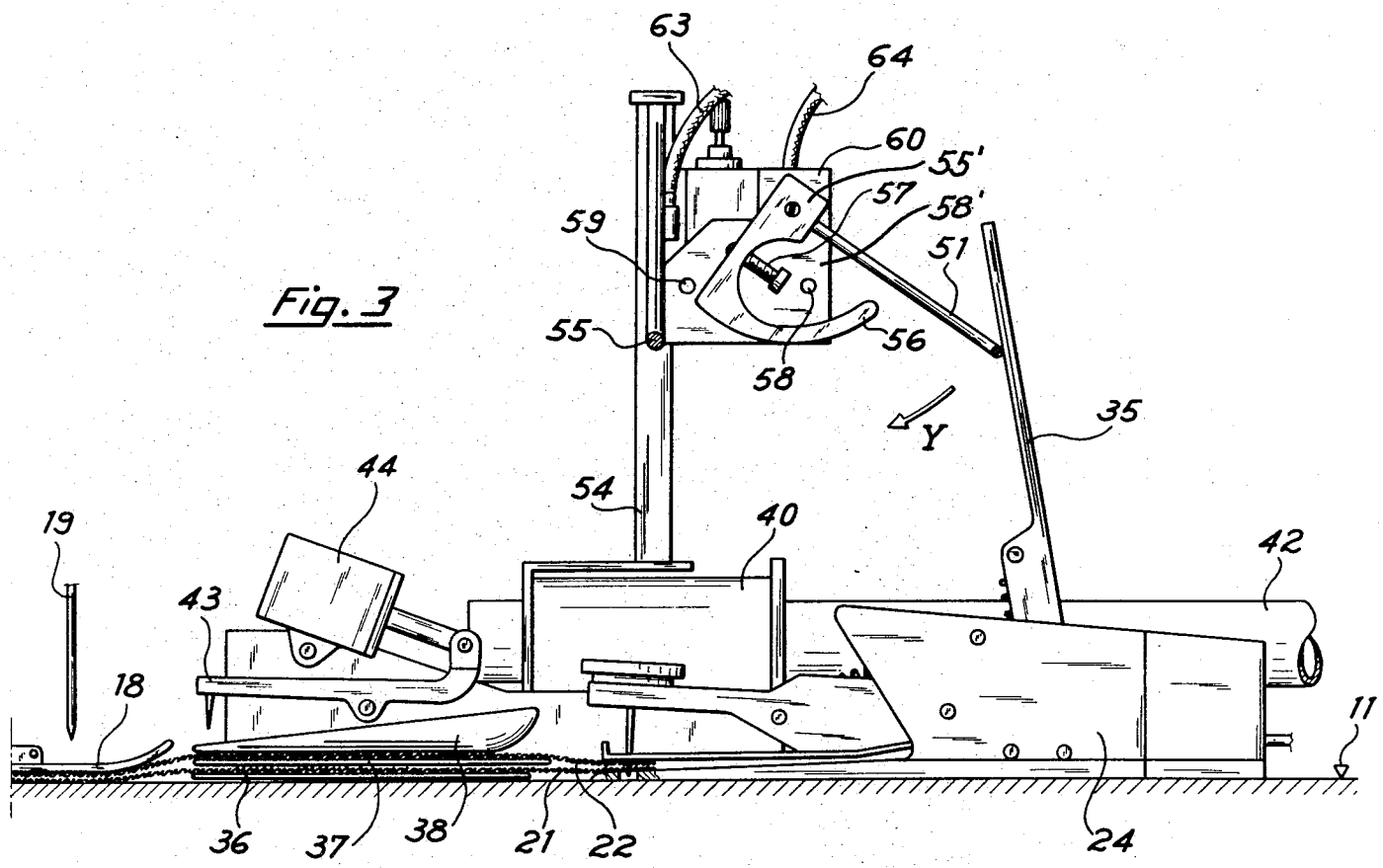
FIG. 3 is a view in side elevation showing the tensioning device in a position to initiate displacement of the guiding device.

The present invention permits a workpiece to be subjected to the action of the tensioning device up to a position where its trailing end corresponds to the location of the stitching instrumentalities which is considered a very definite advance in the art relative to the known types of sewing units which are only capable of tensioning a workpiece up to substantially the same position as shown in FIG. 3. This creates an undesirable condition for after the workpieces released by the gripper, a considerable amount of the workpiece must pass through the guide without tension being applied thereto and the guide is ineffective in performing its intended function without tension on said workpiece.

Immediately upon release of the gripper 24 from the trailing end of the workpiece, the counterweight 27 is effective in returning said gripper to its initial or starting position where it is caused to seat in the guiding and positioning member 26. This movement releases rod 51 from contact with the fingers 35 and by means of counterweight 53 said rod automatically returns to its initial position. The return of rod 51, as described, also pivots the control block 55' so that its arcuated finger 56 will effect the opening of port 59 causing a discharge of air pressure from the cylinder 50. Immediately upon release of the pressure in cylinder 50, the guide 20 is caused to return to its operating position shown in FIG. 2.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

We claim:

1. A control apparatus for a workpiece guide mounted for sliding movement on the worksurface of a sewing unit intermediate a sewing machine and a traveling gripper for applying tension to a workpiece being advanced on the worksurface to the stitching instrumentalities of the machine, said control apparatus comprising:

(a) a guide support member (39) mounted on the sewing unit for effecting limited longitudinal sliding movement of the guide to a position of close proximity with the stitching instrumentalities;

(b) means operatively connected to said support member for moving the latter and guide carried thereby in a direction perpendicular to the direction of advance of a workpiece;

(c) activating means connected to and for actuating said moving means; and (d) means carried by the traveling gripper for actuating said moving means through said activating means to effect clearing the pathway of the traveling gripper and permit the latter to advance to that position of close proximity with the stitching instrumentalities from which the guide was displaced by said moving means.

2. The apparatus according to claim 1 wherein said moving means defines a pneumatic cylinder (50) having a piston rod (50') operatively connected to said support member (39).

3. The apparatus according to claim 1 wherein said activating means defines a fluidic cell having a T-connector (62) for controlling flow of compressed air including:

(a) an intake port (63) for receiving compressed air;

(b) a feed port (64) connected to said pneumatic cylinder (50) and an exhaust port 59; and (c) a pivotably mounted control block (55') operatively connected to said fluidic cell and pivotal according to the dictates of said actuating means between positions for closing and opening said exhaust port 59 to effect the flow of compressed air to and from said pneumatic cylinder (50).

4. The apparatus according to claim 3 wherein said control block (55') includes a U-shaped rod (51) fixed thereto and extending therefrom to a position to be engaged by said activating means and effect pivotal movement of said control block.

5. The apparatus according to claim 4 wherein said actuating means defines a generally upwardly directed finger (35).

* * * * *